US008107844B2

(12) United States Patent
Harigae

(10) Patent No.: US 8,107,844 B2
(45) Date of Patent: Jan. 31, 2012

(54) METHODS AND SYSTEMS FOR IMAGE FORMING APPARATUS CONTROL AND SETTING

(75) Inventor: Makoto Harigae, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 887 days.

(21) Appl. No.: 12/133,022

(22) Filed: Jun. 4, 2008

(65) Prior Publication Data

US 2008/0304849 A1 Dec. 11, 2008

Related U.S. Application Data

(60) Provisional application No. 60/942,547, filed on Jun. 7, 2007.

(51) Int. Cl.
*G03G 15/00* (2006.01)

(52) U.S. Cl. ..... 399/81

(58) Field of Classification Search ..... 399/81–83
See application file for complete search history.

(56) References Cited

FOREIGN PATENT DOCUMENTS

| | | | |
|---|---|---|---|
| JP | 08185300 A | * | 7/1996 |
| JP | 2002-036673 | | 2/2002 |
| JP | 2004-226843 | | 8/2004 |
| JP | 2004-326394 | | 11/2004 |
| JP | 2004326394 A | * | 11/2004 |

* cited by examiner

*Primary Examiner* — David Gray
*Assistant Examiner* — Laura Roth
(74) *Attorney, Agent, or Firm* — Turocy & Watson, LLP

(57) ABSTRACT

The subject innovation relates to an image forming apparatus that includes a control panel capable of displaying a menu screen, and enabling users to set a plurality of image forming conditions. Furthermore, an image forming unit can execute image forming processing according to the conditions set via the control panel. A first control unit can be configured to control a reader and writer to write setting information into a storage medium, and to read the setting information stored in the storage medium. In, addition, a second control unit can be configured to control content of the menu screen in accordance with the setting information read from the storage medium when the control panel is operated to set an image forming condition, and to display setting items for condition setting on the menu screen in a predetermined order.

16 Claims, 8 Drawing Sheets

FIG.7

| NO. | SETTING ITEM ID | SETTING ITEM NANE | SETTING ITEM VALUE 1 | SETTING ITEM VALUE 2 | FREQUENCY OF USE | DATE AND TIME |
|---|---|---|---|---|---|---|
| 1 | 001 | BINDING MARGIN | LEFT | 10 | 5 | 2008-01/09 12:30 |
| 2 | 002 | DOUBLE-SIDE | BOOK | 0 | 10 | 2007-12/27 16:00 |
| 3 | 003 | DENSITY | +3 | 0 | 5 | 2007-12/27 14:50 |
| 4 | 004 | N in 1 | 2 in 1 | LEFT-RIGHT | 15 | 2007-12/25 11:40 |
| 5 | 005 | STAPLE | TOP LEFT | 0 | 5 | 2007-12/22 10:00 |
| 6 | 006 | DOUBLE-SIDE | TABLET | 0 | 2 | 2007-12/20 09:30 |
| : | : | : | : | : | : | : |
| : | : | : | : | : | : | : |
| n | 010 | STAPLE | LEFT | DOUBLE | 1 | 2007-10/05 10:30 |

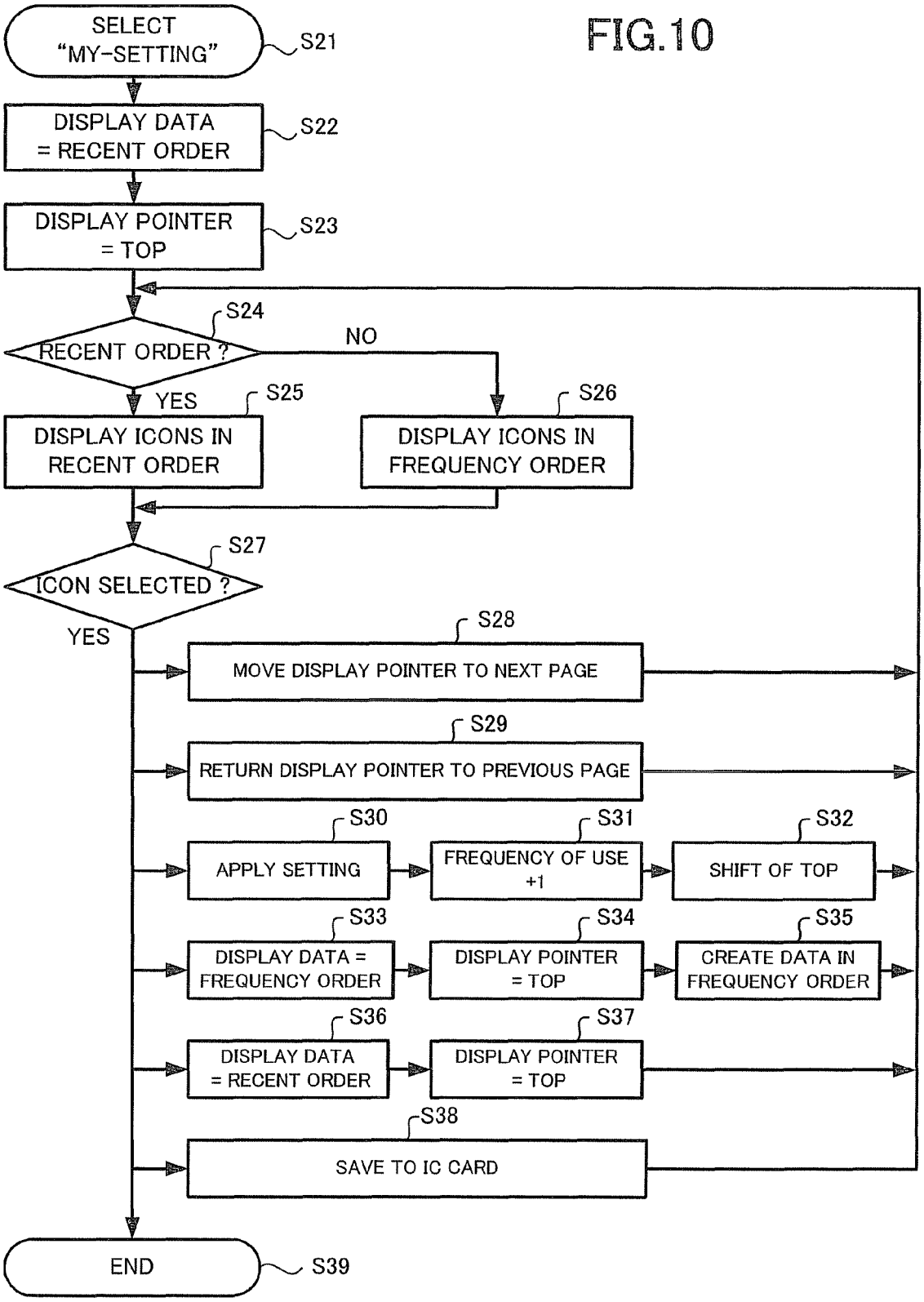
FIG.10
SELECT "MY-SETTING"
S21
DISPLAY DATA = RECENT ORDER
S22
DISPLAY POINTER = TOP
S23
S24
RECENT ORDER ?
NO
YES
S25
DISPLAY ICONS IN RECENT ORDER
S26
DISPLAY ICONS IN FREQUENCY ORDER
S27
ICON SELECTED ?
YES
S28
MOVE DISPLAY POINTER TO NEXT PAGE
S29
RETURN DISPLAY POINTER TO PREVIOUS PAGE
S30
APPLY SETTING
S31
FREQUENCY OF USE +1
S32
SHIFT OF TOP
S33
DISPLAY DATA = FREQUENCY ORDER
S34
DISPLAY POINTER = TOP
S35
CREATE DATA IN FREQUENCY ORDER
S36
DISPLAY DATA = RECENT ORDER
S37
DISPLAY POINTER = TOP
S38
SAVE TO IC CARD
END
S39

METHODS AND SYSTEMS FOR IMAGE FORMING APPARATUS CONTROL AND SETTING

CROSS-REFERENCE TO RELATED APPLICATION

This application is based upon and claims the priority of U.S. Provisional Application No. 60/942,547, filed on Jun. 7, 2007, the entire contents of which are incorporated herein by reference.

BACKGROUND OF THE INVENTION

1. Field of the Invention

The present invention relates to an image forming apparatus such as a multi-function peripheral (MFP), which is a digital multi-function machine, a copy machine or a printer, and a setting method for the image forming apparatus.

2. Description of the Related Art

Generally, an image forming apparatus such as a MFP, copy machine or printer may have plural functions including the copy function, scanner function and so on. Particularly, in a multi-function image forming apparatus, when copying image data, the user sets image forming conditions (for example, copy sheet size, N in 1, density, binding margin and so on) by operating a control panel. An image forming apparatus may also have a finisher that performs post-processing such as stapling and sorting, in which case conditions such as the presence or absence of staple processing are set.

When setting these conditions, the user needs to select a desired setting item from a menu screen displayed on the control panel and input more detailed settings.

Generally, since menu screens are displayed in a hierarchical manner, the user must carry out many operations to have a desired setting item shown. Moreover, since it is difficult to know which hierarchical level of menu screen contains the desired setting item, it takes time to set conditions.

To deal with this, there is an image forming apparatus in which setting contents for each individual are stored in a job memory. In this case, the past setting contents stored in the job memory are read out and conditions for copying and so on can be set in accordance with the read-out setting information. Therefore, the user does not have to repeat operations on menu screens and setting screens.

However, as the job memory is provided in the MFP body and many unspecified users use the image forming apparatus, the stored contents in the job memory may be overwritten by other users. Also, when using another MFP, the user must reset the conditions.

JP-A-2004-326394 discloses an image forming system. In this example, a communication unit is provided in an image forming apparatus and this communication unit sends and receives signals to and from an IC card carried by a specified user. The IC card is used as a job memory and can store copying conditions set by the user.

JP-A-2004-226843 discloses an image forming apparatus using an IC card. In this example, only an operator who is carrying the IC card can carry out maintenance of the image forming apparatus.

However, in the conventional techniques, when the user uses the image forming apparatus to carry out copy processing and so on, the operation to set image forming conditions for each individual is troublesome. Copying cannot be done quickly and is time-consuming.

SUMMARY OF THE INVENTION

It is an object of the invention to provide an image forming apparatus which enables condition setting and quick processing by simple operations when the user carries out copy processing and so on by using the image forming apparatus.

According to an aspect of the present invention, there is provided an image forming apparatus comprising: a control panel including a display unit and capable of displaying a menu screen for setting an image forming condition in the display unit; an image forming unit configured to carry out image forming processing under the condition set by the control panel; a reader and writer capable of communicating with a portable storage medium; a first control unit configured to control the reader and writer to write setting information at the time the image forming condition is set, into the storage medium, and to read the setting information stored in the storage medium; and a second control unit configured to control a content of the menu screen in accordance with the setting information read from the storage medium when the control panel is operated to set an image forming condition, and to display plural setting items for condition setting on the menu screen in predetermined order.

BRIEF DESCRIPTION OF THE DRAWINGS

FIG. 7 is an explanatory view showing an example of stored information in an IC card in an image forming apparatus according to an embodiment of the invention.

FIG. 10 is a flowchart for explaining operations at the time of operating a menu screen in the embodiment.

DETAILED DESCRIPTION OF THE INVENTION

Figure 1:
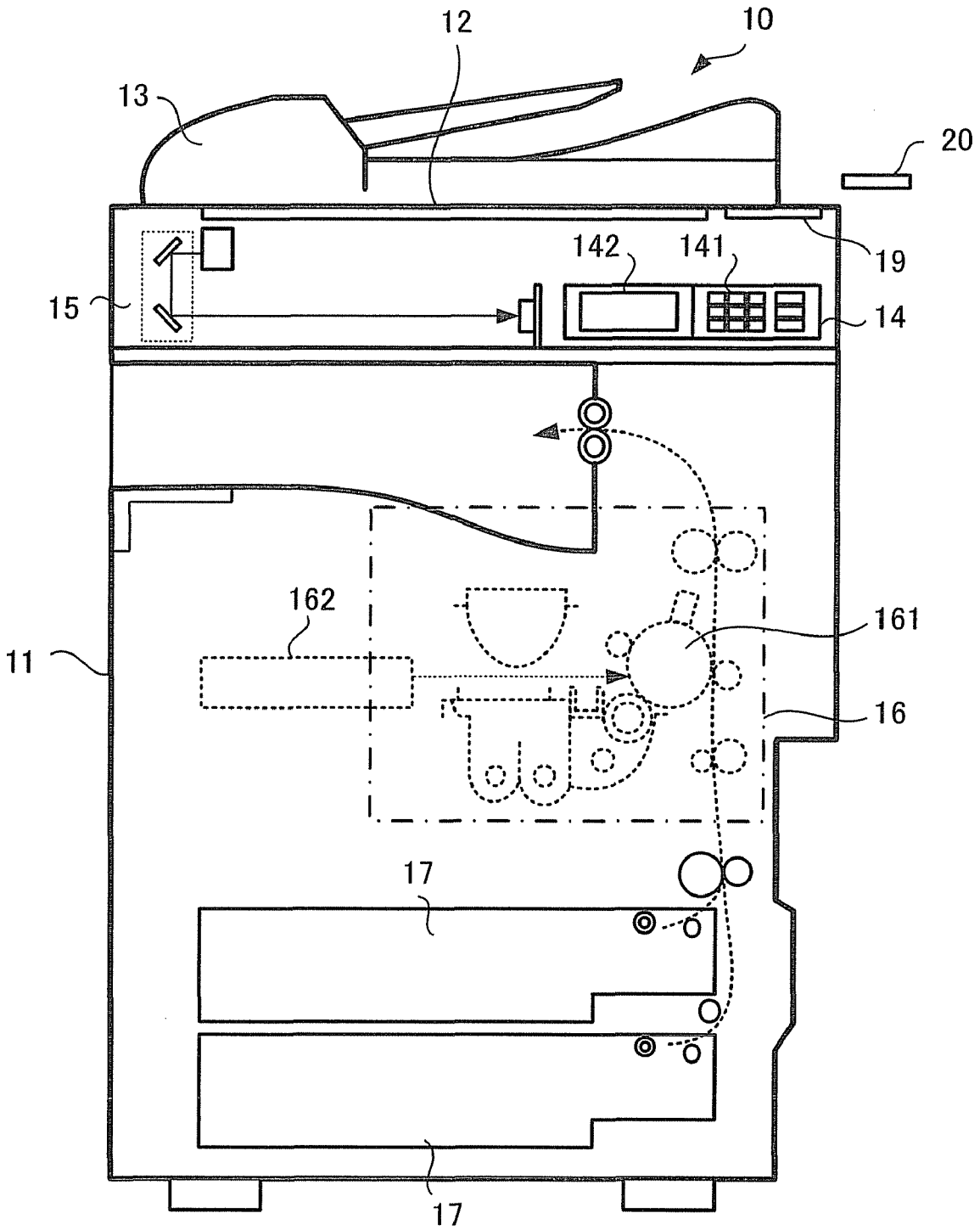
FIG. 1 is a view showing a schematic configuration of an image forming apparatus according to an embodiment of the invention.

Throughout this description, the embodiment and example shown should be considered exemplars, rather than limitations on the apparatus and methods of the present invention.

Hereinafter, an embodiment of the invention will be described with reference to the drawings. The same parts in the drawings are denoted by the same reference numerals.

FIG. 1 is a configuration view showing an embodiment of an image forming apparatus according to the invention. In the following description, a multi-function peripheral (MFP), which is a multi-function machine, will be described as an example. However, the invention can also be applied to other types of image forming apparatuses such as printers and copy machines.

In FIG. 1, numeral 10 refers to an MFP (image forming apparatus). A document table 12 is provided at the top of a body 11 of the MFP 10. An automatic document feeder (ADF) 13 is provided on the document table 12 in such a manner that the ADF can freely open and close. A control panel 14 is further provided at the top of the body 11. The control panel 14 has an operation unit 141 including various keys, and a touch panel-type display unit 142.

A scanner 15 and a printer 16 are provided in the body 11. Moreover, plural cassettes 17 in which sheets of various sizes are housed are provided at the bottom of the body 11. The scanner 15 scans a document sent by the ADF 13 or a document set on the document table 12. The printer 16 includes a photoconductive drum 161 and a laser 162. A laser beam from the laser 162 scans and exposes the surface of the photoconductive drum 161 and thus creates an electrostatic latent image on the photoconductive drum 161.

A charging unit, a developing unit, a transfer unit and so on are arranged around the photoconductive drum 161. The electrostatic latent image on the photoconductive drum 161 is developed by the developing unit and a toner image is thus formed on the photoconductive drum 161. The toner image is transferred to a sheet by the transfer unit and then fixed to the sheet by a fixing unit. The configuration of the printer 16 is not limited to the configuration shown in FIG. 1 and various systems may be employed.

On the top side of the body 11, a non-contact card reader and writer 19 is provided. The card reader and writer 19 is capable of communicating with a storage medium 20 (for example, IC card 20) carried by the user. The user is authenticated by holding the IC card 20 over the card reader and writer 19. The authenticated user can now use the MFP 10 (this will be described in detail later). The IC card 20 includes a storage unit. In the storage unit, identification information such as user ID is stored.

Processing functions carried out by the MFP 10 include, for example, a copy function, printer function, scanning function, network print function and so on.

The copy function includes monochrome copy and color copy functions. The printer function is the function to print image data. The scanning function is the function to save, as an image file, image data scanned by the scanner 15 into a shared folder connected via a network, not shown. The network print function is the function to print image data sent to the body 11 from an external device such as a personal computer (PC), on the side of the body 11.

The MFP 10 carries out image formation on a sheet by using the scanner 15 and the printer 16 provided in the body 11. If a post-processing device (not shown) called a finisher is connected to the body 11 of the MFP 10, sort processing and staple processing can be carried out by this finisher. Therefore, the image forming unit including the scanner 15, the printer 16 and the finisher carries out image formation and post-processing to sheets in accordance with conditions set by the user.

Figure 2:
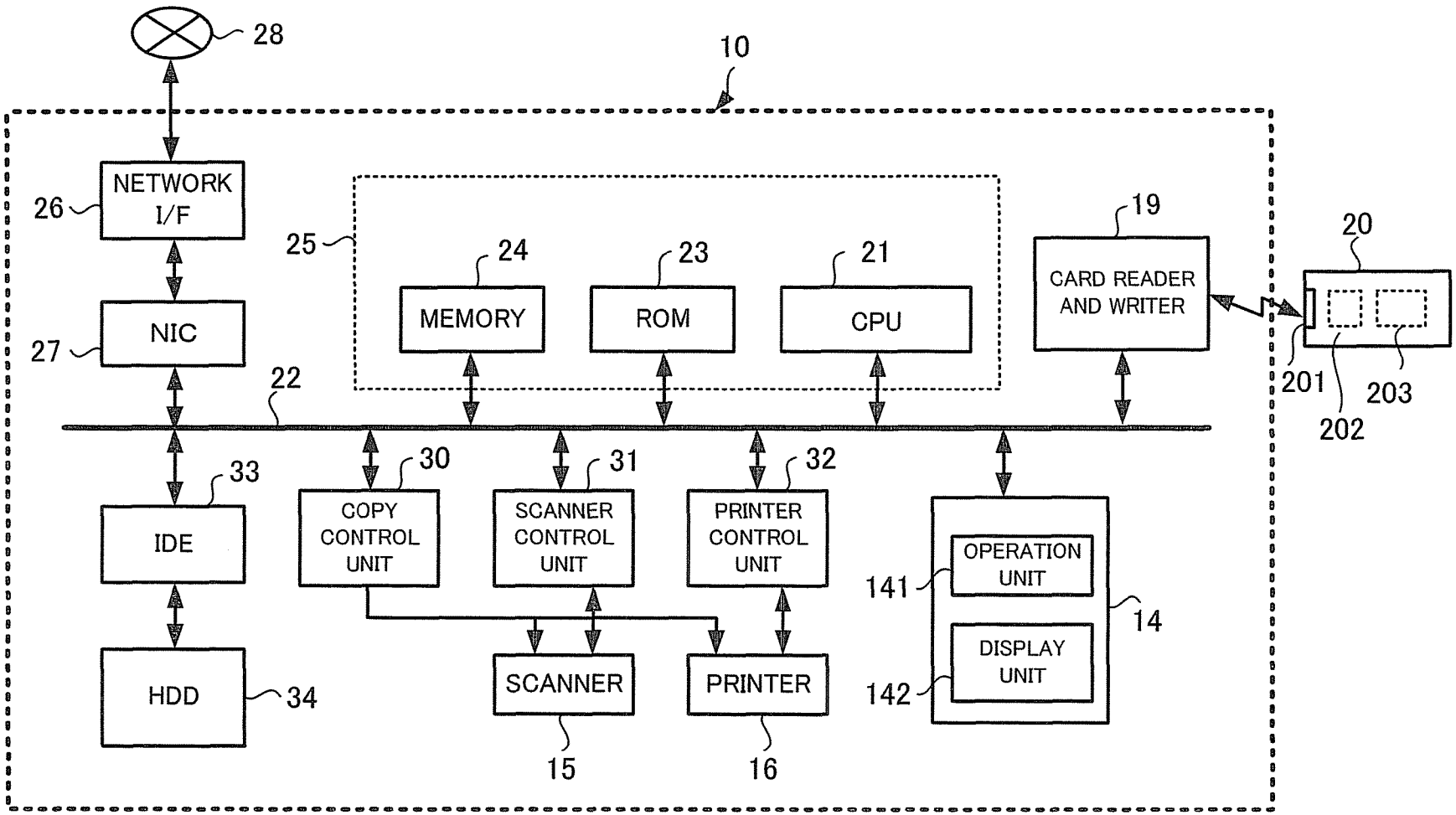
FIG. 2 is a block diagram showing a configuration of an image forming apparatus according to an embodiment of the invention.

FIG. 2 is a block diagram showing a configuration of the MFP 10. The MFP 10 is provided with a CPU 21. The CPU 21 is connected to a PCI bus 22. The "PCI bus" is an abbreviation of Peripheral Component Interconnect Bus.

The card reader and writer 19 is connected to the PCI bus 22. The card reader and writer 19 communicates with the IC card 20. The card reader and writer 19 can read information stored in the IC card 20 in a non-contact manner and can also write information to the IC card 20 in a non-contact manner.

Also a ROM 23 and a memory 24 are connected to the PCI bus 22. The ROM 23 and the memory 24, together with the CPU 21, constitute a main control unit 25. Various control programs that are necessary for the operation of the body 11 are stored in the ROM 23. The memory 24 can store various data.

The MFP 10 is provided with a network interface 26. The network interface 26 is connected to the PCI bus 22 via a network interface card (NIC) 27.

The network interface 26 includes a LAN board, FAX modem and so on and is connected to an external device, for example, a PC, via an external communication network (LAN) 28. The NIC 27 is to control transmission and reception of data to and from the external device via the network interface 26.

Moreover, a copy control unit 30, a scanner control unit 31, a printer control unit 32, and the control panel 14 are connected to the PCI bus 22. Also, an HDD 34 as a storage device is connected to the PCI bus 22 via an IDE 33. The IDE 33 is an interface to connect the HDD 34 to the PCI Bus 22. It is an abbreviation of Integrated Device Electronics.

The copy control unit 30 controls the ordinary copy function using the scanner 15 and the printer 16. The scanner control unit 31 controls the scanning function using the scanner 15. The printer control unit 32 controls the print function using the printer 16. Image data at the time of print processing by the printer 16 is stored into the HDD 34.

The IC card 20 has a communication unit 201 that communicates with the card reader and writer 19, and a CPU 202 that controls the communication unit 201. The IC card 20 also includes a storage unit 203 capable of storing various kinds of information.

The IC card 20 is carried by the user who uses the MFP 10. As the user holds the IC card 20 over the card reader and writer 19 when using the MFP 10, the information stored in the storage unit 203 is read by the card reader and writer 19. For example, RFID (Radio Frequency Identification) is suitable as a communication system between the card reader and writer 19 and the IC card 20.

Figure 3:
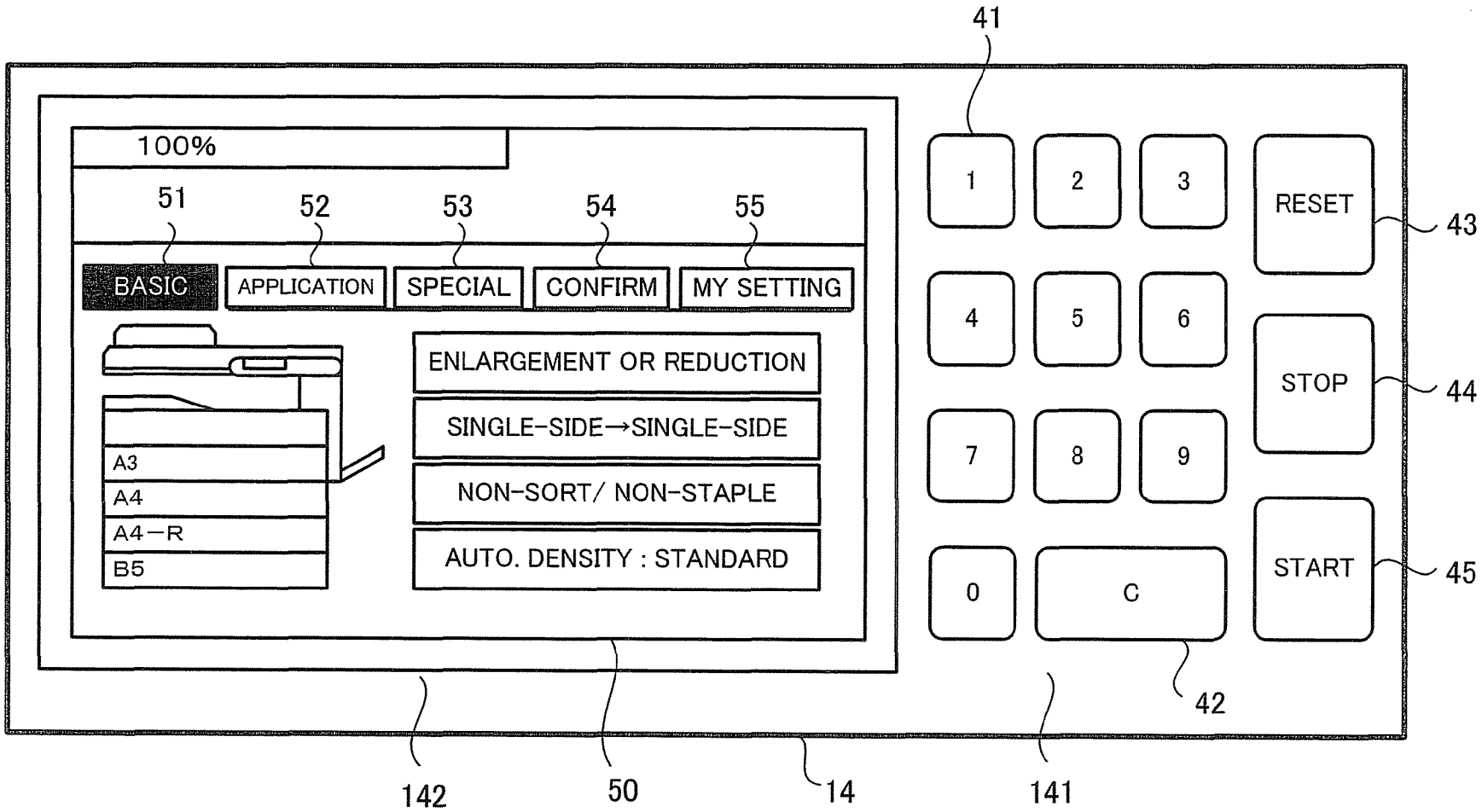
FIG. 3 is a plan view showing an exemplary control panel of an image forming apparatus according to an embodiment of the invention.

FIG. 3 shows an example of the control panel 14. In FIG. 3, numeral 141 represents the operation unit, which has ten keys 41, a clear key 42, a reset key 43, a stop key 44, a start key 45 and so on.

Numeral 142 represents the display unit, which has the touch panel function. On the display screen of the display unit 142, various menu screens 50 of basic, application, special, confirmation, my setting and so on can be displayed as index buttons 51 to 55 are selected.

FIG. 3 shows the menu screen 50 of the display unit 142 in the initial stage when the user has set a document. The index buttons 51 to 55 are shown in the menu screen 50. The index buttons 51 to 54 are for displaying common menu screens of, for example, "basic", "application", "special", and "confirmation". The index button 55 of "my setting" is for displaying a menu screen for personal setting.

When user uses the display unit 142 to set image forming conditions, the user operates one of the index buttons 51 to 55 of FIG. 3. In the example of FIG. 3, the menu screen 50 in the case where the "basic" index button 51 is selected is shown. "Basic" job items include standard setting items such as 100% enlargement or reduction, single-side to single-side copy, non-sort and non-staple, and standard print density.

Meanwhile, if the user wants to set other conditions, the user can select the "application" index button 52 for various other settings. For example, a case where the user sets a binding margin will be described with reference to FIG. 4A to FIG. 4C.

Figure 4A:
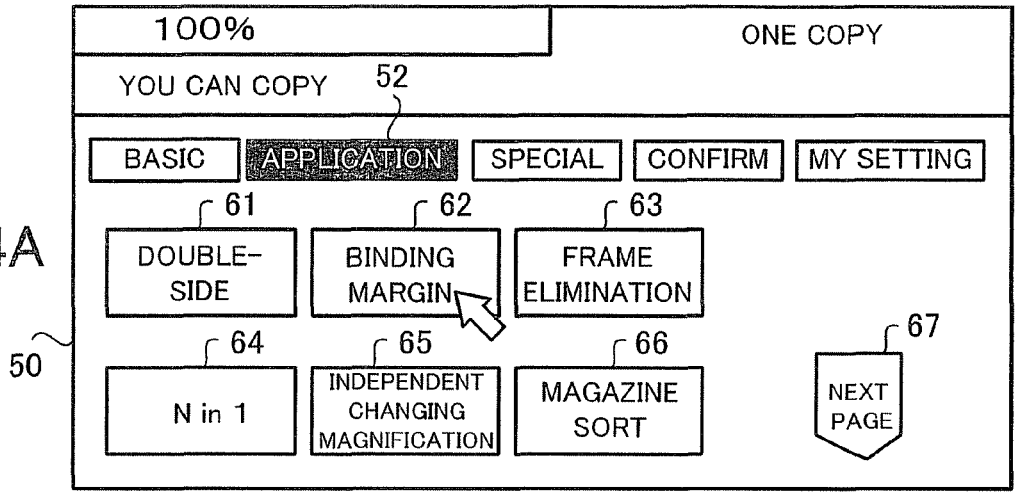
FIG. 4A to FIG. 4C are explanatory views showing an exemplary setting method in the case of setting image forming conditions by using a control panel.

If the user selects the "application" index button 52 in FIG. 3, the menu screen 50 related to "application" as shown in FIG. 4A is shown in the display unit 142. The menu screen includes plural setting items. Each setting item is shown as an icon. The icons include, for example, icons 61 to 66 to set "double-side", "binding margin", "frame elimination", "N in 1", "independent changing magnification", "magazine sort" and so on.

Figure 4B:
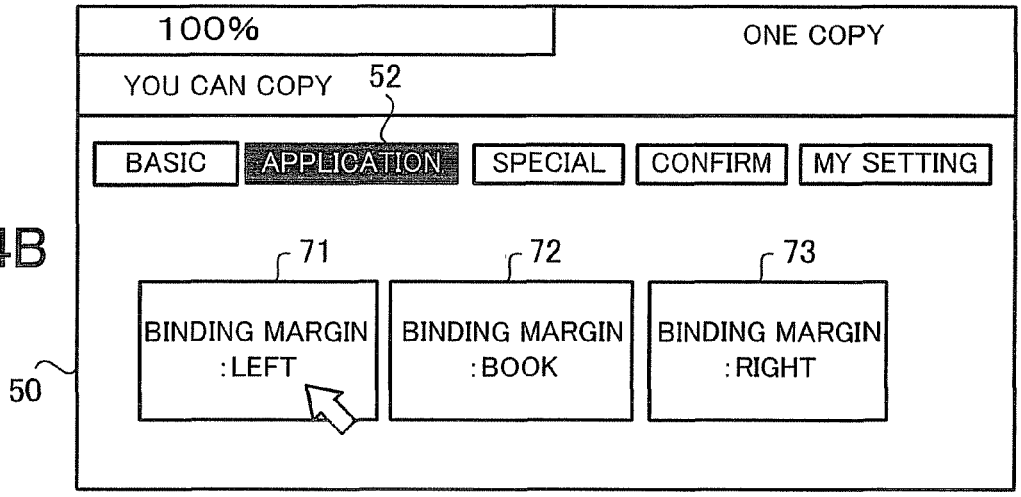

If the user selects the "binding margin" icon 62 here, the menu screen 50 of a lower layer for binding margin setting as shown in FIG. 4B is shown. The setting screen for binding margin includes, for example, "binding margin: left", "binding margin: book" and "binding margin: right" icons 71, 72 and 73.

Figure 4C:
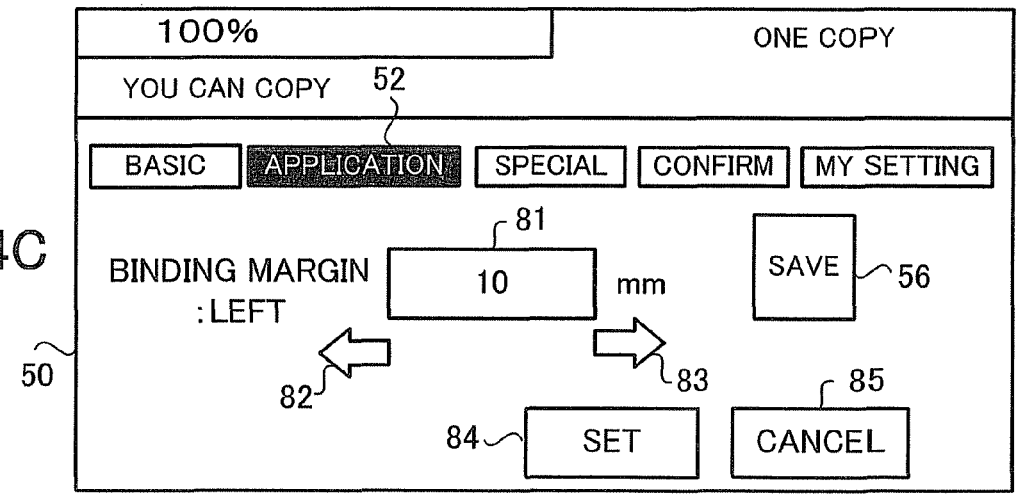

Next, if the user selects the "binding margin: left" icon 71, the menu screen 50 of a lower layer for setting the width of the binding margin as shown in FIG. 4C is shown. In this menu screen, a window 81 to designate the setting of the left binding margin by the millimeter, and arrow icons 82 and 83 are shown. The width of the binding margin can be reduced by pressing the arrow icon 82 and increased by pressing the arrow icon 83. The numeric value in the window 81 represents the value (for example, 10 mm) of the binding margin (left). If the user wants to set the binding margin at this value, the user can press a setting icon 84. If the user wants to make a correction, the user can press a cancellation icon 85. Moreover, in FIG. 4C, if the user wants to save the setting contents at the time when the setting is completed, the user can press a "save" button 56 to store the setting information to the IC card 20.

In the case of setting other items than the binding margin, the user can select other icons (61, 63, 64, 65 and 66) in FIG. 4A. For example, if the icon 61 is pressed, plural setting items (icons) related to double-side printing are shown. If a desired item cannot be found among the icons of FIG. 4A, the user can press a "next page" icon 67 so that icons of other setting items are shown.

In this manner, the user can set desired image forming conditions by operating the "application" index button 52 and sequentially operating icons included in lower-layer menus.

However, in this setting method, since the menu screens are displayed in a hierarchical manner, the user needs to carry out many operations to have a desired setting item shown. Moreover, since it is difficult to know which hierarchical level of menu screen contains the desired setting item, it takes time to set conditions.

Thus, the present invention is characterized in that user-specific setting can be quickly carried out, other than the general setting method as described above.

In the present invention, the non-contact card reader and writer 19 is attached to the MFP 10 and information in the IC card 20 carried by the user is read, as shown in FIG. 2. The IC card 20 can store personal information for authorizing the individual user and can also store information of setting conditions that were set when the user used the MFP 10 in the past.

The MFP 10 reads the user's personal information by the card reader and writer 19 and thus carries out user authentication when the user holds the IC card 20 over the card reader and writer 19. As a method of user authentication, it is possible to previously register in the MFP 10 a user who is allowed to use the MFP 10 or to carry out authentication by using an authentication server or the like, not shown, which is connected via the LAN 28. When the user is authenticated, the user can use the MFP 10. As will be described later, when the user is authenticated, the information of conditions that were set by the user in the past is read from the IC card 20 and temporarily saved in the memory 24 of the MFP 10.

On the menu screen 50 in the display unit 142 of the MFP 10, the "my setting" index button 55 is provided. As the user operates the "my setting" index button 55, a setting item that the user often uses and its set value are shown in the form of a menu screen for personal setting from the setting information temporarily saved in the memory 24.

For setting item icons shown in the "my setting" menu screen, one of two display formats can be selected, that is, a "recent" display format in which setting items that have recently been used are shown, and a "frequency" display format in which setting items that have been frequently used are shown.

Operation procedures in the case of setting image forming conditions according to the invention will be described with reference to FIG. 5 and FIG. 6.

Figure 5:
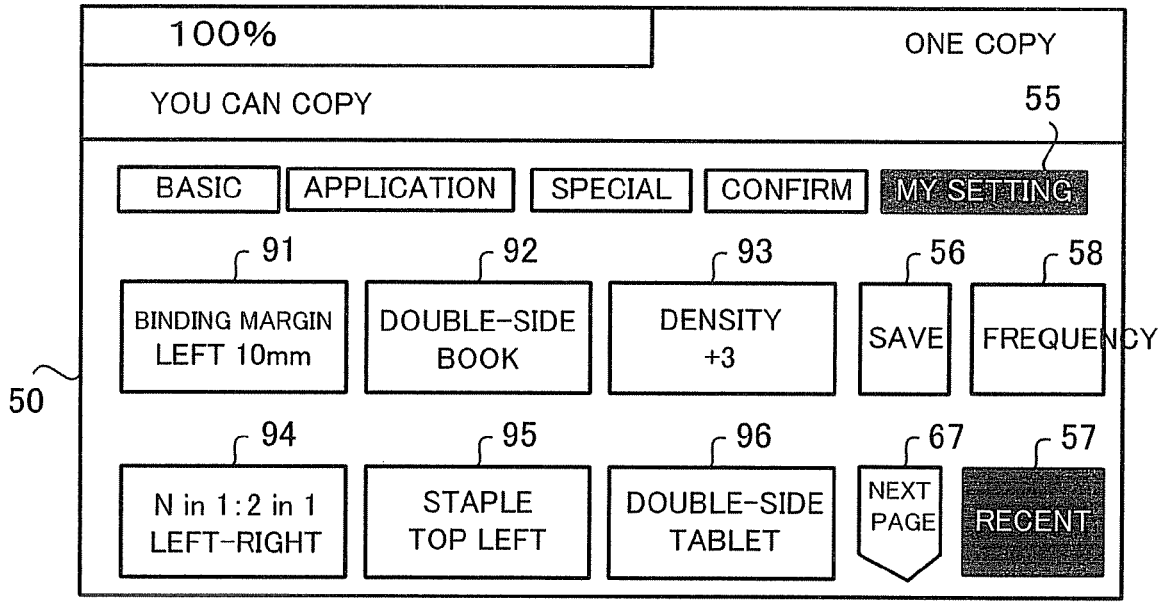
FIG. 5 and FIG. 6 are explanatory views showing another exemplary setting method in the case of setting image forming conditions by using a control panel.

First, if the user selects the "my setting" index button 55 in the initial menu screen of FIG. 3, the "my setting" menu screen 50 as shown in FIG. 5 is shown in the display unit 142. The menu screen 50 includes plural setting items that the user has recently set. For example, icons 91 to 96 of "binding margin: left 10 mm", "double-side: book", "density: +3", "N in 1: 2 in 1 left-right", "staple: top left", "double-side: tablet" and so on are shown.

The menu screen 50 of FIG. 5 is formed on the basis of information of several conditions settings that have been carried out by the user operating the MFP 10. The icons 91 to 96 are displayed in order from the most recently set item. Therefore, the user can select a desired setting condition from this menu. For example, when the user wants to copy under the condition of "binding margin: left 10 mm", the user can press the icon 91.

Figure 6:
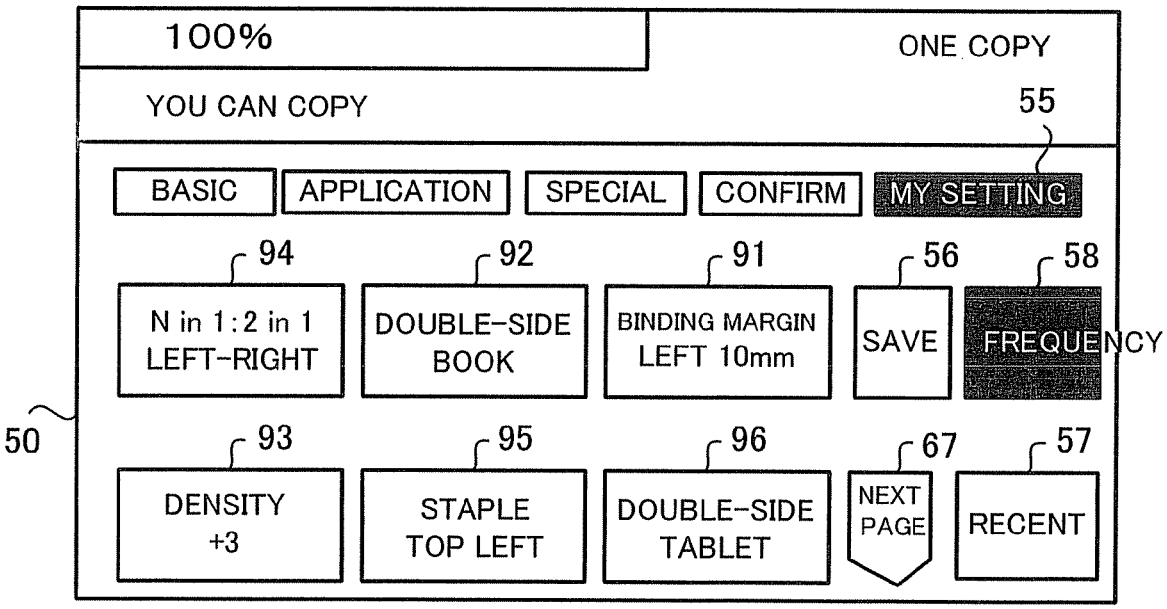

Meanwhile, if the user presses a "frequency" icon 58 shown in the menu screen 50, setting items that have been frequently used, of the plural setting items set by the user, are shown in order from the most frequently used item, as shown in FIG. 6.

In FIG. 6, for example, the icons 94, 92, 91, 93, 95 and 96 are shown according to the order of "N in 1: 2 in 1 left-right", "double-side: book", "binding margin: left 10 mm", "density: +3", "staple: top left", and "double-side: tablet". In this example, the number of times the user set the copy condition of "N in 1: 2 in 1 left-right" in the past is the largest.

Since the setting items are shown in order from the most frequently used item, the user can select a desired setting condition from this menu. For example, if the user wants to copy under the condition of "N in 1: 2 in 1 left-right", the user can press the icon 94.

If the user wants to have the icons shown in the recently set order in the menu screen 50 of FIG. 6, the user can press the "recent" icon 57 to change the display contents of FIG. 5. When the "my setting" index button 55 has been operated, arbitrary setting is possible with respect to whether to have the "recent" menu screen (FIG. 5) displayed or to have the "frequency" menu screen (FIG. 6) displayed.

For example, the "recent" menu screen is set to be displayed preferentially, and after that, the user can switch whether to have the "frequency" menu screen displayed or to have the "recent" menu screen displayed by operating the "frequency" icon 58 or the "recent" icon 57.

In the case where users set image forming conditions, the conditions set are uneven for each user. For example, user A tends to often copy plural documents to one sheet by N in 1, whereas user B tends to often staple copied sheets.

This is associated with the duties of the user who uses the MFP 10. In setting image forming conditions, each individual tends to frequently use more or less limited kinds of conditions. Therefore, if the recently set contents or contents that were frequently set in the past are shown for each user, the user can immediately select his or her desired setting item.

In the menu screens 50 of FIG. 5 and FIG. 6, the number of setting items (icons) that can be shown in one screen is limited. Therefore, if there are more setting items, these items will be shown in the next page. To have the next page shown, the user operates the "next page" icon 67. When the "next page" icon 67 is pressed, the display shifts to the next page and the other setting item icons are displayed. When the next page is shown, a "previous page" icon (not shown) is displayed as well as the "next page" icon 67, and the display can return to the previous page.

In FIG. 5 and FIG. 6, if the "save" button 56 is pressed when the setting is completed, the setting information can be stored into the IC card 20. The setting information thus stored in the IC card 20 is hereinafter referred to as my-setting information. In this way, the recently set contents are stored in the IC card 20 and if the same contents as the previous setting are set, the numeric value of frequency of use is incremented (+1) and stored.

FIG. 7 is an explanatory view showing an example of my-setting information stored in the storage unit 203 of the IC card 20. In FIG. 7, the top row represents setting condition items stored in the IC card 20, and the leftmost column represents the order in which each item is stored.

The my-setting information includes "setting item ID", "setting item name", "setting item value 1", "setting item value 2", "frequency of use" and so on. The information of "date and time" is stored as well. For example, when a binding margin is set, the setting item ID "001" and the setting item name "binding margin" are stored. Information of "left" as the setting item value 1 and "10 mm" as the setting item value 2 is stored.

In FIG. 7, the item NO. 1 is the recent my-setting information. When the "save" button is pressed now, the information that has been at the positions of NO. 1, NO. 2, . . . sequentially shifts to the next rank in order and the latest my-setting information is stored at the highest rank. In the case where the same condition of the binding margin as in the previous setting is set, the frequency of use is incremented by 1 and the number of times data of the frequency of use is changed and stored, for example, as "5". The my-setting information is stored into the IC card 20 together with date and time information when the user has pressed the "save" button 56 of FIG. 4C, FIG. 5 or FIG. 6.

Thus, as the user presses the index button of "my setting" 55, the setting items 91 to 96 are shown in the menu screen 50 in the recently set order, as shown in FIG. 5. Meanwhile, if the user has pressed the "frequency" button 58, the setting items 94, 92, 91, . . . are shown in order from the most frequently used item, as shown in FIG. 6. Moreover, if the "recent" button 57 is pressed, the display returns to FIG. 5 and the setting items 91 to 96 are shown in the recently set order.

When the index buttons 51, 52 and 53 of "basic", "application", "special" or the like are operated and a new conditions is set, the setting item and its set value are sequentially stored into the IC card 20 as recent my-setting information in accordance with an instruction from the user. Thus, the icon of the new setting item is added to the menu screen of "my setting" 55.

To save my-setting information into the IC card 20, the user can simply press the "save" icon 56 in the my-setting menu screen and hold the IC card 20 over the card reader and writer 19.

The IC card 20 can also be used for other MFPs that support the menu functions of "my setting" 55. As the IC card 20 is simply held over the card reader and writer of the other MFPs, my-setting information is read. Then, the user can easily set a desired image forming condition simply by selecting and pressing an icon displayed in the menu screen.

Figure 8:
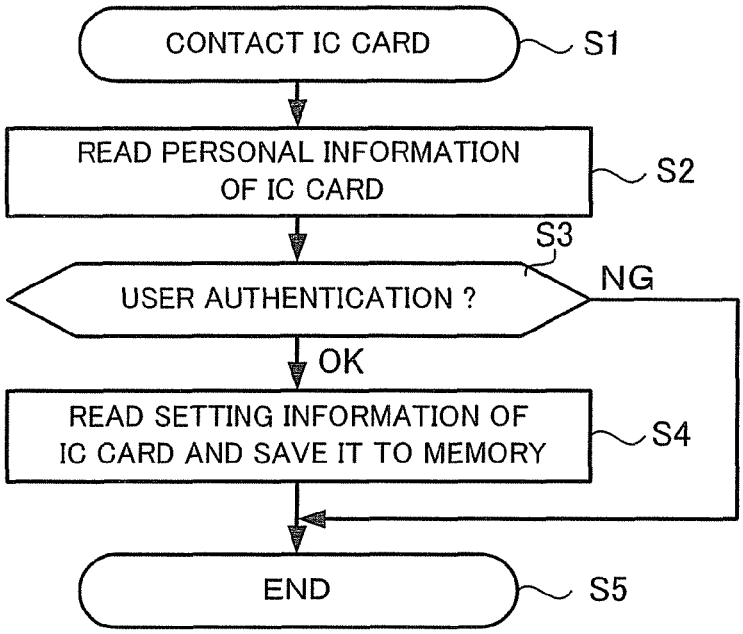
FIG. 8 is a flowchart for explaining an IC card reading operation in the embodiment.

FIG. 8 is a flowchart showing processing at the main control unit 25 when the IC card 20 is held over or caused to contact the card reader and writer 19 of the MFP 10.

As the IC card 20 is held over the card reader and writer 19 of the MFP 10 in step S1 of FIG. 8, the card reader and writer 19 reads personal information saved in the IC card 20 in step S2. Next, user authentication is carried out in step S3. As the user is authenticated, the processing goes to step S4. If the user is not authenticated, the processing ends there. In step S4, the card reader and writer 19 reads my-setting information (FIG. 7) saved in the IC card 20 and temporarily saves the read information into the memory 24.

Therefore, the main control unit 25 constitutes a first control unit that controls the card reader and writer 19 to write, to the IC card 20, setting information at the time when the user sets image forming conditions, and to read the setting information stored in the IC card 20.

Figure 9:
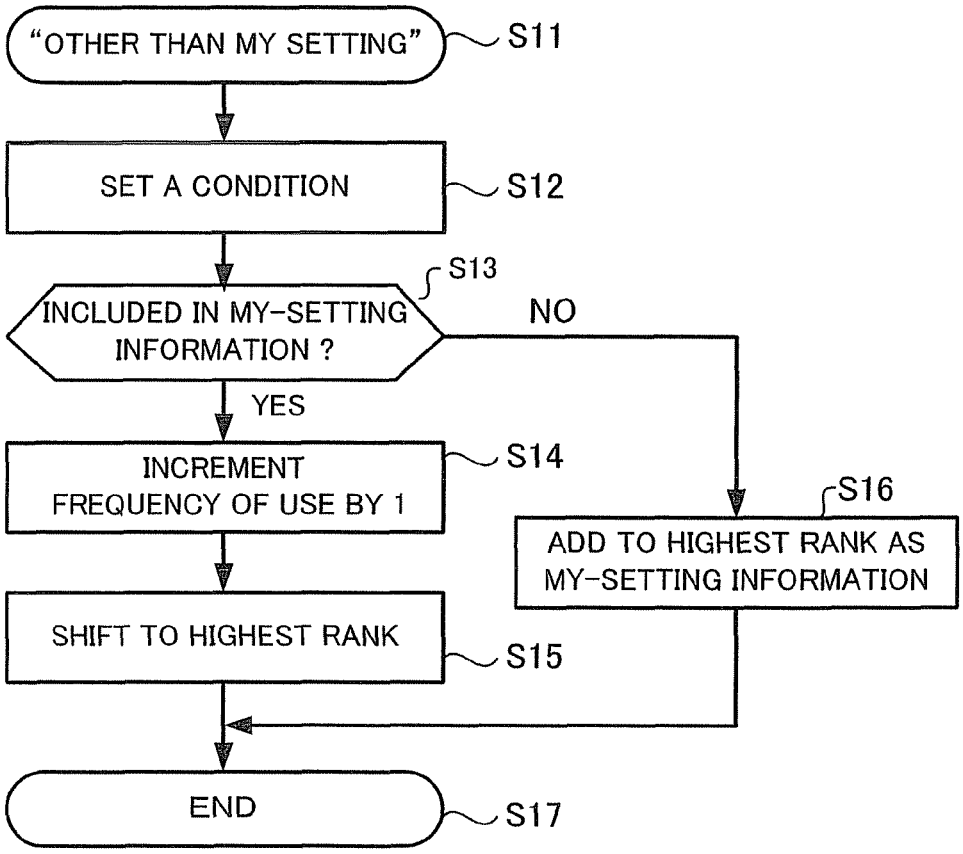
FIG. 9 is a flowchart for explaining an information writing operation to the IC card in the embodiment.

FIG. 9 is a flowchart showing processing at the main control unit 25 in the case where any of the other index buttons 51 to 54 than "my setting" is pressed in the menu screen 50.

If any of the other index buttons than "my setting" is pressed in step S11 of FIG. 9, an image forming condition is set in accordance with the user's operation in step S12. For example, if the "application" index button 52 is pressed, a condition is set in accordance with the procedures described with reference to FIG. 4A to FIG. 4C.

In the next step S13, it is determined whether the set item is included in the my-setting information read out of the IC card 20 or not. If the item set in step S12 is included in the my-setting information (YES), the value of the frequency of use of that setting information is incremented by 1 in step S14. The setting information is shifted to the highest rank (top position) of the my-setting information in step S15.

If the item set in step S12 is not included in the my-setting information (No in the determination in step S13), the item is newly added to the highest rank (top position) as the my-setting information. The my-setting information of FIG. 7 is constantly updated in this manner. Since the storage capacity of the IC card 20 is not infinite, information that is old and used less frequently can be deleted from the my-setting information.

FIG. 10 is a flowchart showing display processing in the menu screen by the main control unit 25 when the "my setting" index button 55 is operated.

As the "my setting" index button 55 is pressed in step S21 of FIG. 10, the my-setting information written from the IC card 20 to the memory 24 is read. In step S22, display data is arrayed in the recent order in order to show a menu screen based on the my-setting information in the memory 24. In step S23, a display pointer is placed at the top position.

In the next step S24, it is determined which of the "recent" order and the "frequency" order should be taken. If the recent order is taken, icons corresponding to the number of icons that can be shown in one screen are shown in order from the display data of the top position, in step S25 (see FIG. 5).

If the frequency order is taken, icons are shown in order from the highest frequency in accordance with the frequency data of the my-setting information in step S26. Also in this case, icons corresponding to the number of icons that can be shown in one screen are shown (see FIG. 6).

In the next step S27, it is determined which icon is selected in the menu screen of "my setting" 55. In the subsequent steps, processing corresponding to this selection is carried out.

For example, if the "next page" icon 67 is pressed, the display pointer is moved forward to the next page in step S28. If the "previous page" icon is pressed, the display pointer is moved back to the previous page in step S29. The "save" icon 56 for saving the my-setting information is displayed as well. Thus, when the "next page" icon 67 is pressed, the display shifts to the icon display of the next page. When the "previous page" icon is pressed, the display can go back to the icon display of the previous page.

If one of the setting icons (91 to 96) is pressed in the menu screen of "my setting" 55, the pressed setting item is applied to the MFP 10 in step S30. In step S31, the frequency of use data for the corresponding setting item, of the my-setting information in the memory 24, is incremented by 1. In step S32, that setting item is moved to the top position of the my-setting information.

Meanwhile, if the "frequency" icon 58 is pressed, the display data is arrayed in the frequency order in step S33. In step S34, the display pointer is moved to the top position. In step S35, the menu item data of "my setting" are sorted according to the frequency order to create my-setting item data in the frequency order. Thus, the menu screen according to the frequency order can be shown.

If the "recent" icon 57 is pressed, the display data is shown in the recent order in step S36 and the display pointer is moved to the top position in step S37. Thus, the menu screen displayed in the frequency order can go back to the menu screen in the recent order.

Thus, the main control unit 25 constitutes a second control unit that controls the contents of the menu screen 50 in accordance with the my-setting information read from the IC card 20 when the user operates the control panel 14 to set an image forming condition, and that displays plural setting items (icons) for condition setting in the menu screen 50 in the order desired by the user.

Moreover, if the "save" icon 56 is pressed, in step S38, the my-setting information in the memory 24 is written to the IC card 20 when the IC card 20 is caused to contact the card reader and writer 19. If the IC card 20 is not caused to contact the card reader and writer 19 in a few seconds, time-out processing is carried out, that is, saving processing is canceled.

In this manner, when a setting icon is pressed on the menu screen 50 of "my setting" 55, the corresponding setting processing is carried out. If any of other icons than the above is pressed, the processing ends in step S39.

As described above, according to the embodiment of the invention, condition setting at the time of image formation can be easily carried out in accordance with the convenience for individual users. Moreover, condition setting can be easily carried out also in other MFPs having similar functions.

Although exemplary embodiments of the present invention have been shown and described, it will be apparent to those having ordinary skills in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a control panel including a display unit and capable of displaying a menu screen for setting an image forming condition in the display unit, and displaying a "frequency" icon and a "recent" icon on the menu screen;

an image forming unit configured to carry out image forming processing under the condition set by the control panel;

a reader and writer capable of communicating with a portable storage medium;

a first control unit configured to control the reader and writer to write setting information at the time the image forming condition is set, into the storage medium, and to delete setting information that is old and used less frequency from the storage medium, and to read the setting information stored in the storage medium; and a second control unit configured to control a content of the menu screen in accordance with the setting information read from the storage medium when the control panel is operated to set an image forming condition, and to display plural icons of setting items on the menu screen in order from the highest frequency of use if the "frequency" icon is selected, and to display plural icons of setting items on the menu screen in recently set order if the "recent" icon is selected.

2. The image forming apparatus according to claim 1, wherein the storage medium is an IC card and the reader and writer is a card reader and writer that reads information in the IC card in a non-contact manner.

3. The image forming apparatus according to claim 1, wherein the second control unit enables the control panel to display a common menu screen and a menu screen for personal setting, and when display of the menu screen for personal setting is designated, the "frequency" icon and the "recent" icon are displayed on the menu screen.

4. The image forming apparatus according to claim 3, wherein the first control unit reads user identification information stored in the storage medium and carries out authentication of the user, and the second control unit enables the menu screen for personal setting to be displayed to the authenticated user.

5. The image forming apparatus according to claim 3, wherein when the number of the setting items that can be displayed in the menu screen for personal setting is n (where n>1), the second control unit causes setting items subsequent to the n-th setting item to be sequentially displayed in the next page screen.

6. The image forming apparatus according to claim 1, wherein when storing the setting information to the storage medium, the first control unit stores information including setting item, set value, and frequency of setting in order of set date and time.

7. The image forming apparatus according to claim 1, wherein the image forming unit includes a scanner and a printer provided in a body of the image forming apparatus, and a post-processing device connected to the body of the image forming apparatus, and carries out image formation and post-processing to a sheet in accordance with the set condition.

8. A setting method for an image forming apparatus comprising:

displaying a menu screen for setting an image forming condition in a display unit of a control panel, and displaying a "frequency" icon and a "recent" icon on the menu screen;

controlling a reader and writer capable of communicating with a portable storage medium to write setting information when the image forming condition is set, into the storage medium, and to delete setting information that is old and used less frequency from the storage medium, and to read the setting information stored in the storage medium;

controlling a content of the menu screen in accordance with the setting information read from the storage medium when the control panel is operated to set an image forming condition;

displaying plural icons of settings items on the menu screen in order from the highest frequency of use if the "frequency" icon is selected;

displaying plural icons of setting items on the menu screen in recently set order if the "recent" icon is selected; and selecting the icons of setting items displayed on the menu screen and setting an image forming condition.

9. The setting method for the image forming apparatus according to claim 8, wherein the storage medium is an IC card and the reader and writer is a card reader and writer that reads information in the IC card in a non-contact manner.

10. The setting method for the image forming apparatus according to claim 8, wherein the plural setting items are displayed on the menu screen in order from the highest frequency of setting or in recently set order with respect to set conditions.

11. The setting method for the image forming apparatus according to claim 10, wherein the plural setting items are displayed either in the order from the highest frequency of setting or in the recently set order, by selection.

12. The setting method for the image forming apparatus according to claim 8, wherein the control panel is enabled to display a common menu screen and a menu screen for personal setting, and when display of the menu screen for personal setting is designated, the "frequency" icon and the "recent" icon are displayed on the menu screen.

13. The setting method for the image forming apparatus according to claim 12, wherein user identification information stored in the storage medium is read and authentication of the user is carried out, and the menu screen for personal setting is enabled to be displayed to the authenticated user.

14. The setting method for the image forming apparatus according to claim 12, wherein when the number of the setting items that can be displayed in the menu screen for personal setting is n (where n>1), setting items subsequent to the n-th setting item are sequentially displayed in the next page screen.

15. The setting method for the image forming apparatus according to claim 8, wherein when storing the setting information to the storage medium, information including setting item, set value, and frequency of setting is stored in order of set date and time.

16. The setting method for the image forming apparatus according to claim 8, wherein image formation and post-processing to a sheet is carried out in accordance with the set condition.

* * * * *